US005092594A

United States Patent [19]

Jang

[11] Patent Number: 5,092,594

[45] Date of Patent: Mar. 3, 1992

[54] SHOCK ABSORBING STRUCTURES OF A GAME RACKET HANDLE

[75] Inventor: Jiuh-Luh Jang, Taichung Hsien, Taiwan

[73] Assignee: Yea Tay Enterprise Co., Ltd., Taiwan

[21] Appl. No.: 658,598

[22] Filed: Feb. 21, 1991

[51] Int. Cl.[5] ..... A63B 49/08

[52] U.S. Cl. ..... 273/73 R; 273/73 J

[58] Field of Search ..... 273/73 R, 73 J, 75, 273/81 R; 81/22, 489, 127.1

[56] References Cited

U.S. PATENT DOCUMENTS 4,033,583 7/1977 Ehrhart ..... 273/73 R

FOREIGN PATENT DOCUMENTS 2166960 5/1986 United Kingdom ..... 273/75

2198649 6/1988 United Kingdom ..... 273/73 J

*Primary Examiner*—Edward M. Coven

*Assistant Examiner*—Raleigh W. Chiu

*Attorney, Agent, or Firm*—Browdy and Neimark

[57] ABSTRACT

The shock absorping structures of a game racket handle comprise a throat portion, and a handle. The throat portion is characterized in that it has a unitary handle abutment extending therefrom. The handle is unitary body of a foam material of appropriate rigidity and elasticity. The front section of the handle encases the handle abutment and has a wall thickness being appropriately greater than that of the rear section of the handle. The rear section of the handle comprises a hollow frame of an appropriate length disposed therein. The vibrational force generated by an impact of the ball on the string is transmitted to the handle abutment, where most of the vibrational force will be absorbed effectively by the front section of the handle made of a foam material.

3 Claims, 1 Drawing Sheet

SHOCK ABSORBING STRUCTURES OF A GAME RACKET HANDLE

BACKGROUND OF THE INVENTION

The present invention relates to the structure of a game racket, and more particularly to shock absorbing structure of a game racket.

The impact of a ball on a game racket such as a tennis racket or a squash racket generates a severe shock, which is rapidly transmitted to the racket handle and is prone to bringing about an injury to the arm of a player. The known prior art shock absorbing structures are either embedded in the head frame of the racket or arranged in the form of a plurality of recesses in the rubber handle of the racket; nevertheless their shock absorbing effects are often disappointing. Another prior art involves a spring or an elastomer as a shock absorbing structure to couple the head frame and the handle, which are manufactured separately. But such set up is too complicated structurally and involves a tedious manufacturing process. In addition, its structural strength and striking force against the ball are greatly compromised.

SUMMARY OF THE INVENTION

The primary objective of the present invention is to provide a game racket handle with shock absorbing structures capable of preventing effectively the vibrational force from being transmitted to the handle from the head frame upon an impact of the ball on the string.

It is another objective of the present invention to provide a game racket handle with outstanding shock absorbing structures, which have a superior constructional strength and can be made easily.

In keeping with the principles of the present invention, the primary objectives of the present invention are accomplished by the shock absorbing structures of a game racket handle, which comprise a throat portion and a handle. The throat portion is characterized in that it has a unitary handle abutment extending therefrom. The handle is a unitary body of a rigid elastic material. The front section of the handle encases the handle abutment and has a wall thickness being greater than that of the rear section of the handle. The rear section of the handle comprises a hollow frame disposed therein. The vibrational force generated by an impact of the ball on the string is transmitted to the handle abutment, where most of the vibrational force will be absorbed effectively by the front section of the handle made of foam material.

DETAILED DESCRIPTION OF THE PREFERRED EMBODIMENT

Figure 1:
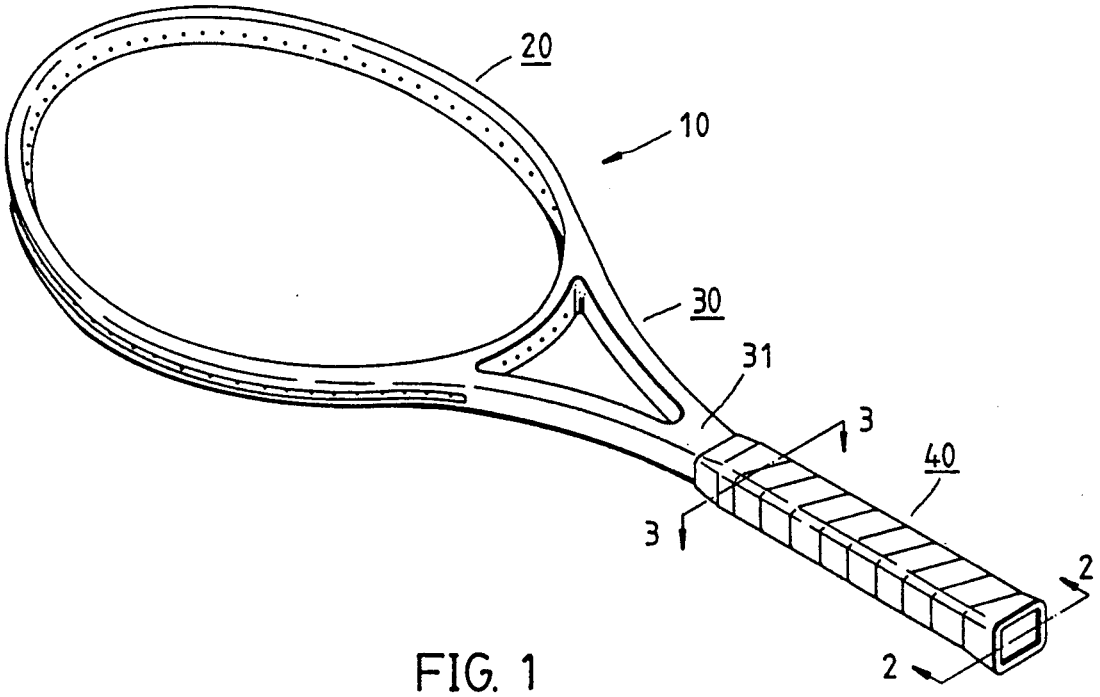
FIG. 1 shows a three-dimensional view of a game racket embodied in the present invention.
Figure 2:
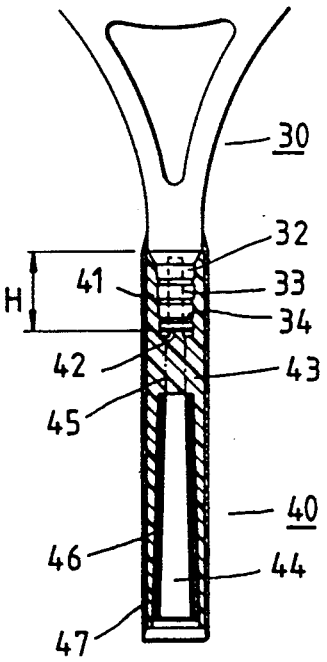
FIG. 2 shows a cut-away view of the handle of the game racket shown in FIG. 1.
Figure 3:
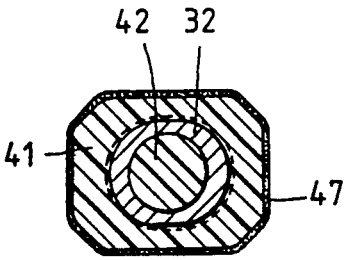
FIG. 3 shows a cut-away view of the portion taken along the line 3—3 as shown in FIG. 1.

Referring to FIGS. 1-3, the racket 10 is shown comprising a head frame 20, a throat portion 30, and a handle 40. The throat portion 30 is constructed as an inverted triangular form. The head frame 20 and the throat portion 30 are made into a unitized body. The throat portion 30 is characterized in that it has a bottom end 31 with a handle abutment 32 extending therefrom.

The throat portion 30 and the handle abutment 32 of an appropriate length designated by H are made into a unitized body. The interior of the handle abutment 32 is constructed as a hollow and tubular structure with a through hole 33 disposed therein. The outer diameter of the handle abutment 32 is slightly inclined and is smaller than that of the bottom end 31 of the throat portion 30. The handle abutment 32 comprises a surface having a plurality of ring-shaped grooves 34 of an appropriate depth arranged thereon.

The handle 40 is a unitary body of foam material. Located at the front end of the handle 40 is a front outer tube 41, which encases the handle abutment 32 and has an inner rod 42 arranged at the center thereof so as to fill in the through hole 33 of the handle abutment 32. The inner rod 42 and the ring-shaped grooves 34 ensure that the front end portion of the handle 40 and the handle abutment 32 are coupled securely in place. The front section of the handle 40 comprises a section of solid portion 43 while the rear section of the handle 40 includes a through hole 44 progressively enlarged toward the rear end of the handle 40. The interior of the through hole 44 is of a cone-shaped construction. The length of the solid portion 43 of the handle 40 depends on the strength of foam material used. If an exceedingly strong foam material is used to construct the solid portion 43, a built-in through hole 45 (indicated in dotted lines) constructed in the solid portion 43 is called for in order to reduce the weight of the handle 40.

In addition, the rear section of the handle 40 comprises a hollow frame 46 of an appropriate length disposed therein. The hollow frame 46 can be made of the same material as the head frame or even made simultaneously with the throat portion 30. The hollow frame 46 serves to reduce the thickness of the handle 40 made of foam material. The handle 40 can be encased with a covering material 47 so that it looks like the handle of an ordinary game racket.

When a vibrational force generated by an impact of the ball on the string is transmitted to the handle abutment 32, a major portion of it will be absorbed effectively by the front section of the handle made of foam material. Therefore, the intended objective of the present invention to prevent the shock of striking the ball from transmitting to the player's arm is effectively achieved. In addition, the thickness and rigidity of foam material forming the front section of the handle provides an adequate strength ensuring that the breakage or the breakaway of the handle and the throat portion of the racket does not take place. The handle embodied in the present invention is further characterized in that it has a relatively simple structure and that it can be made easily.

Therefore, advantages of this invention over the prior art have become apparent. In addition, the principles of the embodiment of the present invention described above are applicable to not only the tennis racket but also the squash racket and other types of game racket.

What is claimed is:

1. The shock absorbing structures of a game racket handle comprising:

(a) at least a handle abutment of hollow and tubular construction with a through hole disposed therein, said handle abutment having an outer diameter being inclined and smaller than that of a bottom end of a throat portion, said handle abutment comprising a surface having a plurality of ring-shaped grooves of a depth arranged thereon, said handle abutment and the throat portion being formed into a unitary body; and (b) a tubular handle being a unitary body of foam material, said handle having a front section with a front outer tube encasing said handle abutment. said handle having a hollow rear section, and said front section having a wall thickness being greater than that of said rear section.

2. The shock absorbing structures of a game racket handle in accordance with claim 1, wherein said rear section of said handle comprises a rigid hollow frame disposed therein.

3. The shock absorbing structures of a game racket handle in accordance with claim 1, wherein said front section of said handle has an inner rod arranged at the center thereof so as to fill in said through hole of said handle abutment.

* * * * *